US007051464B2

(12) United States Patent
Kwon

(10) Patent No.: US 7,051,464 B2
(45) Date of Patent: May 30, 2006

(54) ILLUMINATING RAIL SYSTEM

(76) Inventor: Young Chul Kwon, 12174 Woodley Ave., Granada Hills, CA (US) 91344

( * ) Notice: Subject to any disclaimer, the term of this patent is extended or adjusted under 35 U.S.C. 154(b) by 0 days.

(21) Appl. No.: 10/838,065

(22) Filed: May 4, 2004

(65) Prior Publication Data

US 2005/0247233 A1 Nov. 10, 2005

(51) Int. Cl.
*G09F 13/28* (2006.01)

(52) U.S. Cl. ..... 40/550; 362/368; 362/217; 40/464

(58) Field of Classification Search ..... 362/368, 362/217, 219, 223, 376, 581, 359; 40/464, 40/550, 551, 552; 29/854
See application file for complete search history.

(56) References Cited

U.S. PATENT DOCUMENTS

| | | | | |
|---|---|---|---|---|
| 2,131,671 | A * | 9/1938 | Reed | 40/550 |
| 4,439,818 | A * | 3/1984 | Scheib | 362/250 |
| 4,607,444 | A * | 8/1986 | Foster | 40/550 |
| 6,174,065 | B1 * | 1/2001 | Schurch | 362/605 |
| 6,591,527 | B1 * | 7/2003 | Park | 40/564 |
| 6,921,184 | B1 * | 7/2005 | Tufte | 362/368 |

* cited by examiner

*Primary Examiner*—Frantz F. Jules
(74) *Attorney, Agent, or Firm*—Park Law Firm; John K. Park

(57) ABSTRACT

An illuminating rail system comprising a rail defined by an elongate rear surface and an elongate bottom surface, the rear surface attached to a wall outside the system, the bottom surface upwardly recessed to define along the rail a front panel, a rear panel, and a furrow between the front and rear panels, with an elongate illuminator retained in the furrow.

12 Claims, 2 Drawing Sheets

ILLUMINATING RAIL SYSTEM

BACKGROUND OF INVENTION

The present invention relates to a multi-purpose rail. More particularly, the present invention relates to an illuminating rail system attachable to an exterior of a boat, for example, to realize an utmost external decoration and esthetic illumination.

An increasing number of boats carry buffer rails also called rub rails on their exterior to minimize damage from bumping with another boat on the waters. Buffer rails on the market are also expected to carry durability and fade resistance. Such conventional buffer rails simply serve as no more than external attachments for boat protection from possible external impacts. In a practical point of view, however, the utility of the conventional buffer rails is limited to marina where bumping with other boats are usually recorded minimal in damage.

A demand on this market is to enable the buffer rails to serve as decorative tools for the boat day and night on the waters. Another demand is to combine the buffering capacities with illumination characteristics to thereby improve noticeability of the boat at night.

SUMMARY OF THE INVENTION

The present invention is contrived to overcome conventional disadvantages. Accordingly, it is an object of the present invention is to provide an illuminating rail system to realize an utmost external decoration for a boat. Another object is to enable the illuminating rail system to perform an esthetic illumination. A further object is to improve noticeability of the boat on the waters day and night.

To achieve these and other objects, the illuminating rail system comprises a rail defined by an elongate rear surface, an elongate bottom surface and an elongate front surface. The rear surface is attached to a wall outside the system, the bottom surface is upwardly recessed to define along the rail a front panel, a rear panel, and a furrow between the front and rear panels, and the front surface is substantially recessed toward the rear surface to form an elongate opening along the rail. An elongate illuminator is retained in the furrow and a buffer is inserted in the opening to protect the system and the wall.

In an embodiment, the rear panel is draped lower than the front panel is, and the elongate rear surface is substantially vertical. The wall may be an external portion of a boat.

A circuit board is attached to a rail portion within the furrow to become electrically connected to the illuminator. The electric connection further serves as an engagement member to prop the illuminator in the furrow. Further comprised of is a substantially transparent cover detachably covering the furrow.

The illuminator is substantially blocked by the front panel so that the illuminator becomes invisible when viewed from in front of the system. The elongate illuminator is preferably formed of a plurality of stringed light bulbs. The elongate illuminator is formed of a plurality of light emitting diodes horizontally aligned and stringed by a substantially transparent polyvinyl chloride material.

Advantages of the present invention are numerous. First, the application of illumination property to the buffer rails according to the present invention satisfies esthetic decoration desires of those cherishing boats and yachts. Second, the illuminator provided invisible from the front of the rail system increases decoration effects and noticeability of the boat or other decoration object, thereby improving users' satisfaction and product reliability. Third, the simplified illumination mechanism realized by incorporating the light emitting diodes with the rail using epoxy maximizes usability and marketability.

Although the present invention is briefly summarized, the fuller understanding of the invention can be obtained by the following drawings, detailed description and appended claims.

BRIEF DESCRIPTION OF THE DRAWINGS

The above objects and advantages will be more apparent by describing the present invention with reference to the accompanying reference drawings, in which.

DETAILED DESCRIPTION OF THE PREFERRED EMBODIMENTS

Figure 1:
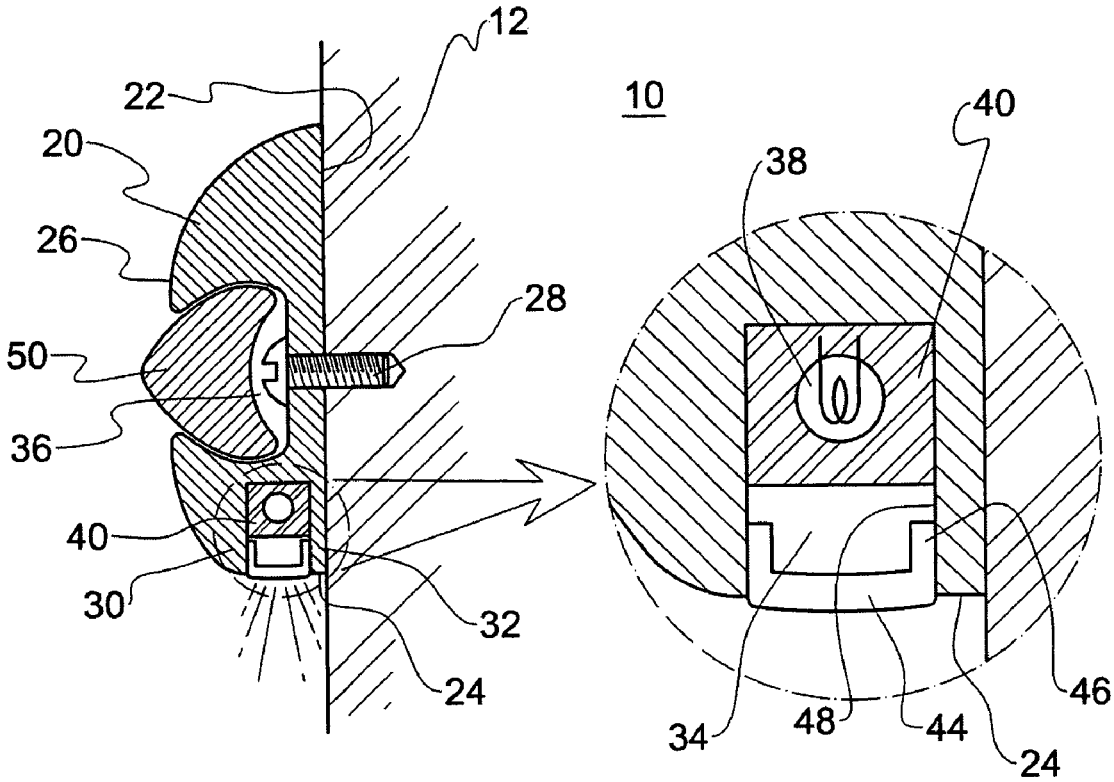
FIG. 1 is a construction view showing an illuminating rail system according to the present invention.
Figure 2:
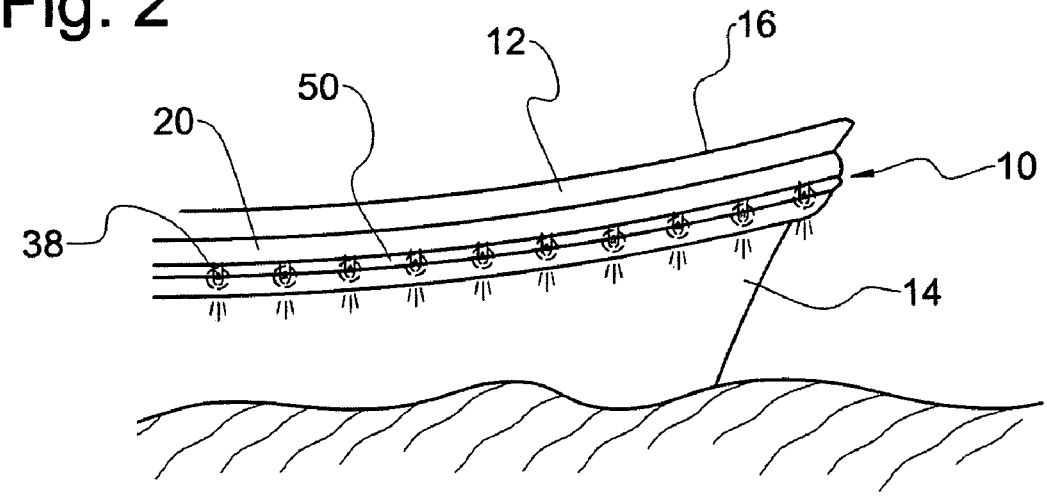
FIG. 2 is a schematic view showing application of the illuminating rail system to a boat.
Figure 3:
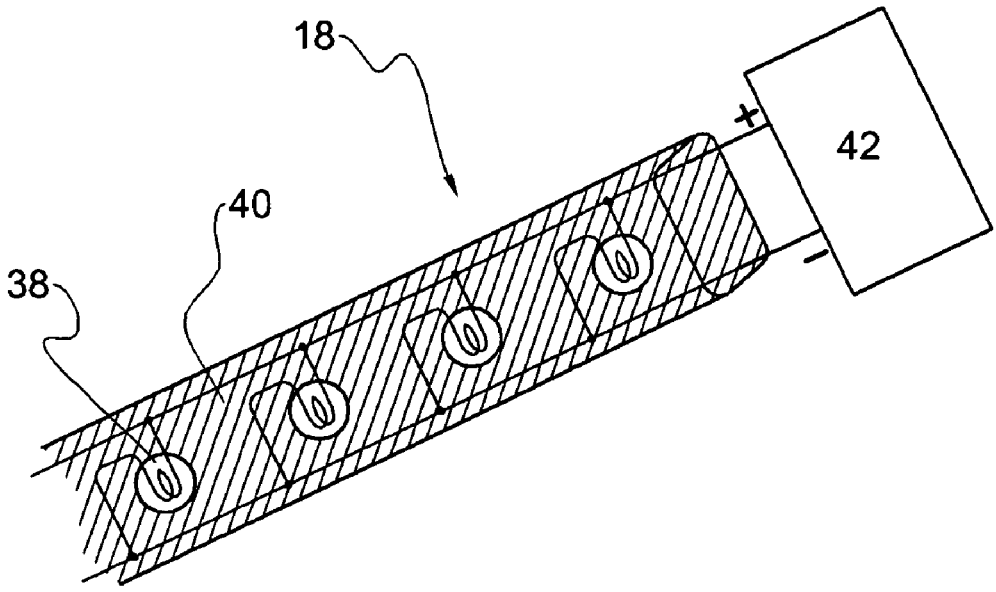
FIG. 3 is a view showing an illuminator according to the present invention.

FIG. 1 shows a preferred embodiment of an illuminating rail system 10 attached on a wall 12 outside the system 10. As shown in FIG. 2, the wall 12 is preferably an external portion 14 of a boat 16. FIG. 3 shows an illuminator 18 in FIG. 1. As shown therein, the illuminating rail system 10 comprises a rail 20 defined by an elongate rear surface 22, an elongate bottom surface 24 and an elongate front surface 26.

The rear surface 22 in a substantially vertical formation is attached to the wall 12 outside the system 10 by an attachment member 28 such as screws. The bottom surface 24 is upwardly recessed to define along the rail 20 a front panel 30, a rear panel 32, and a furrow 34 between the front and rear panels 30, 32. In an embodiment, the front surface 26 is also substantially recessed toward the rear surface 22 to form an elongate opening 36 along the rail 20.

According to this construction, the rail 20 is attached on the wall 12, for example, of boats and yachts most of which carry so called rub rails on and around a selected portion thereof to provide protection from external impacts. Such impacts many times occur in marinas where boats and yachts are docked or parked in vicinity to each other. In a better mode, the rail 20 is formed of a flexible material to allow the rear surface 22 to adjustably correspond to the wall 12.

the rail is formed of a metallic material

For a better performance, an elongate illuminator 18 is provided to become retained in the furrow 34 so as to generate a downward illumination. This type of downward illumination may be employed to improve boat identification and decoration effects.

The elongate illuminator 18 comprises an engagement member 40 to prop the illuminator 18 in the furrow 34. The engagement member 40 is preferably formed of an epoxy material. A circuit board 42 may be attached to a rail portion within the furrow 34 to become electrically connected to the illuminator 18. The electric connection may further serve as an engagement member to prop the illuminator 18 in the furrow 34. The elongate illuminator 18 is formed of a plurality of light emitting diodes (LEDs) 38 horizontally aligned and stringed either by a substantially transparent polyvinyl chloride material or by a substantially transparent epoxy material. Selectively, the elongate illuminator 18 may be formed of a plurality of stringed light bulbs.

In a preferred version, a substantially transparent cover 44 is provided to detachably cover the furrow 34 to protect the illuminator 18 while reserving illuminating color variations by replacing the cover 44 with a colored one. To improve detachable insertion characteristics of the transparent cover 44, vertical wings 46 are formed to upwardly extend along each inner side 48 of the front and rear panels 30, 32 of the rail 20.

Meanwhile, in order to realize the novel utility of the rail system 10, the illuminator 18 is substantially blocked by the front panel 30 so that the illuminator 18 becomes invisible when viewed from in front of the system 10.

Selectively, the rail system 10 further comprises a buffer 50 inserted in the opening 36 to protect the system 10 and the wall 12. The buffer 50 may be formed of a flexible vinyl or rubber material in an elongate shape.

Figure 4:
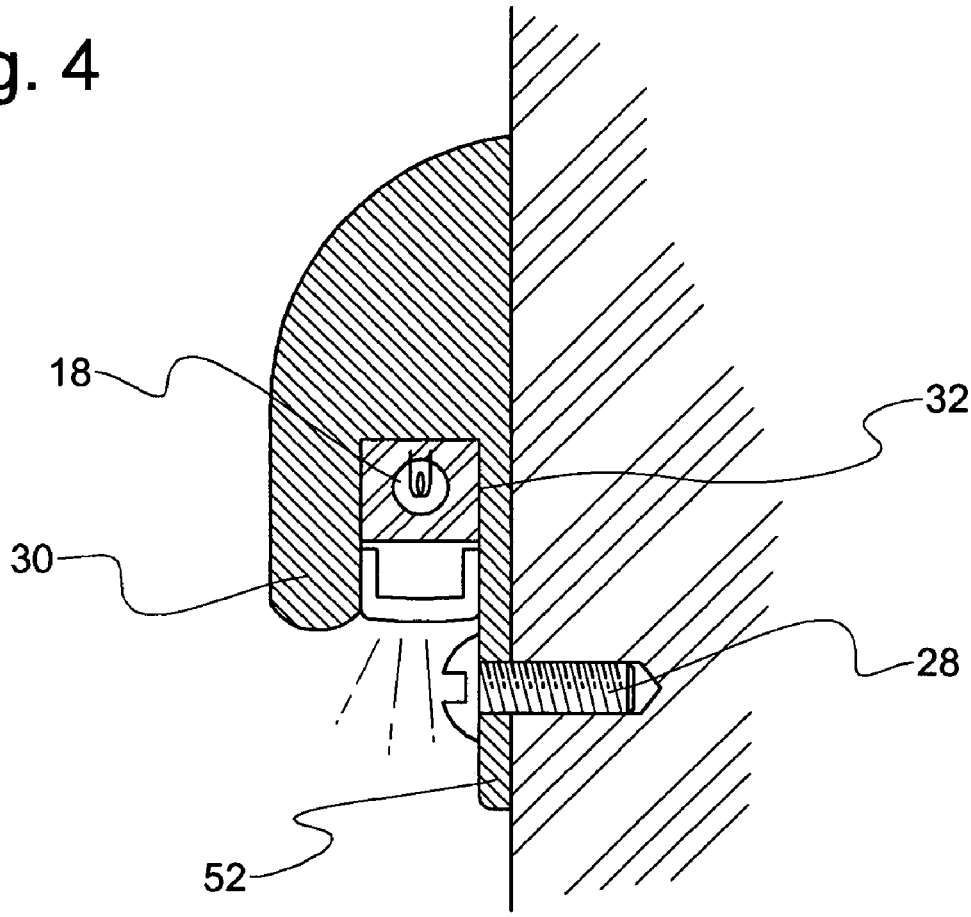
FIG. 4 is a view showing another embodiment of the present invention.

As further shown in FIG. 4, the rear panel 32 is draped lower than the front panel 30 is, so the attachment member 28 is applied through a lower portion 52 of the rear panel 32 below the level of the front panel 30 so as to facilitate the application of the attachment member 28 through the rear panel lower portion 52 and the wall 12.

As discussed above, the illuminating rail system 10 is advantageous in that the application of illumination property to the buffer rail 20 satisfies esthetic decoration desires of those cherishing boats and yachts. Further, the illuminator 18 provided invisible from the front of the rail system 10 increases decoration effects and noticeability of the boat or other decoration object, thereby improving users' satisfaction and product reliability.

In addition, the simplified illumination mechanism realized by incorporating the LEDs 38 with the rail 20 using epoxy maximizes usability and marketability.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An illuminating rail system comprising:

a) a rail defined by an elongate rear surface, an elongate bottom surface and an elongate front surface, wherein the rear surface is attached to a wall outside the system, wherein the bottom surface is upwardly recessed to define along the rail a front panel, a rear panel, and a furrow between the front and rear panels, wherein the front surface is substantially recessed toward the rear surface to form an elongate opening along the rail;

b) an elongate illuminator retained in the furrow; and c) a buffer inserted in the opening to protect the system and the wall.

2. The rail system of claim 1 wherein the illuminator is substantially blocked by the front panel so that the illuminator becomes invisible when viewed from in front of the system.

3. The rail system of claim 2 wherein the rear panel is draped lower than the front panel is.

4. The rail system of claim 1 further comprising an engagement member to prop the illuminator in the furrow.

5. The rail system of claim 1 further comprising a circuit board attached to a rail portion within the furrow to become electrically connected to the illuminator, wherein the electric connection further serves as an engagement member to prop the illuminator in the furrow.

6. The rail system of claim 1 wherein the elongate illuminator is formed of a plurality of stringed light bulbs.

7. The rail system of claim 1 wherein the elongate illuminator is formed of a plurality of light emitting diodes horizontally aligned and stringed by a substantially transparent polyvinyl chloride material.

8. The rail system of claim 1 wherein the rail is formed of a flexible material to allow the rear surface to adjustably correspond to the wall.

9. The rail system of claim 1 wherein the rail is formed of a metallic material.

10. The rail system of claim 1 wherein the elongate rear surface is substantially vertical.

11. The rail system of claim 1 wherein the wall is an external portion of a boat.

12. The rail system of claim 1 further comprising a substantially transparent cover detachably covering the furrow.

* * * * *